United States Patent [19]

Herterich et al.

[11] 3,961,398

[45] June 8, 1976

[54] SEPARABLE FASTENING

[75] Inventors: Walter Herterich, Dachau; Georg Probst, Munich, both of Germany

[73] Assignee: Ecofon Verkaufsgesellschaft Probst KG, Munich, Germany

[22] Filed: Feb. 20, 1975

[21] Appl. No.: 551,265

[30] Foreign Application Priority Data

Feb. 27, 1974 Germany ..... 2409445
Jan. 23, 1975 Germany ..... 2502741

[52] U.S. Cl. ..... 24/205.12; 24/205.13 D; 24/204; 24/205.15 R

[51] Int. Cl.[2] ..... A44B 19/08; A44B 19/40

[58] Field of Search ..... 24/205.12, 205.13 D, 24/204

[56] References Cited

UNITED STATES PATENTS

| | | | |
|---|---|---|---|
| 3,191,255 | 6/1965 | Nealis | 24/205.12 |
| 3,192,589 | 7/1965 | Pearson | 24/204 |
| 3,266,113 | 8/1966 | Flanagan | 24/204 |
| 3,600,766 | 8/1971 | Alberts | 24/205.12 |
| 3,808,646 | 5/1974 | Brumlik | 24/204 |
| 3,849,843 | 11/1974 | Alberts | 24/205.12 |

FOREIGN PATENTS OR APPLICATIONS

| | | | |
|---|---|---|---|
| 589,380 | 3/1959 | Italy | 24/204 |
| 571,001 | 12/1957 | Italy | 24/205.12 |

*Primary Examiner*—Bernard A. Gelak
*Attorney, Agent, or Firm*—Woodhams, Blanchard and Flynn

[57] ABSTRACT

A snap-type fastening for garment belts or the like consists of two arrays of headed pins which can be pressed together to make the fastening. Each array is mounted on a resilient carrier strip and, to ensure a positive opening and closing action, each row of pins is mounted on a nonresilient strip transverse to the lengths of the carrier strips. An operating member of S-form can be used to open and close the fastening.

10 Claims, 8 Drawing Figures

Fig. 1
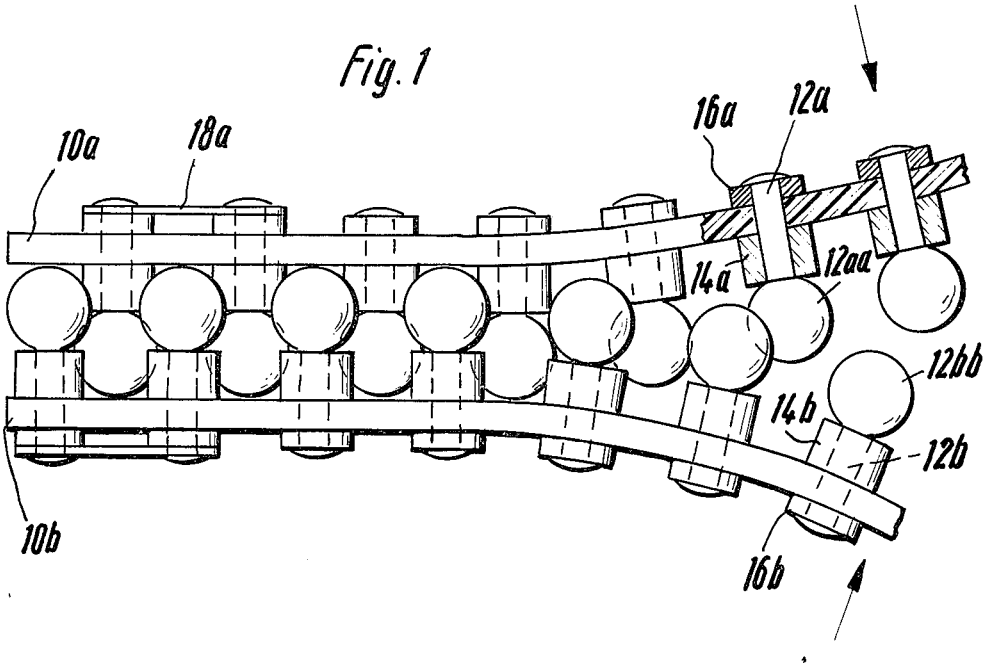
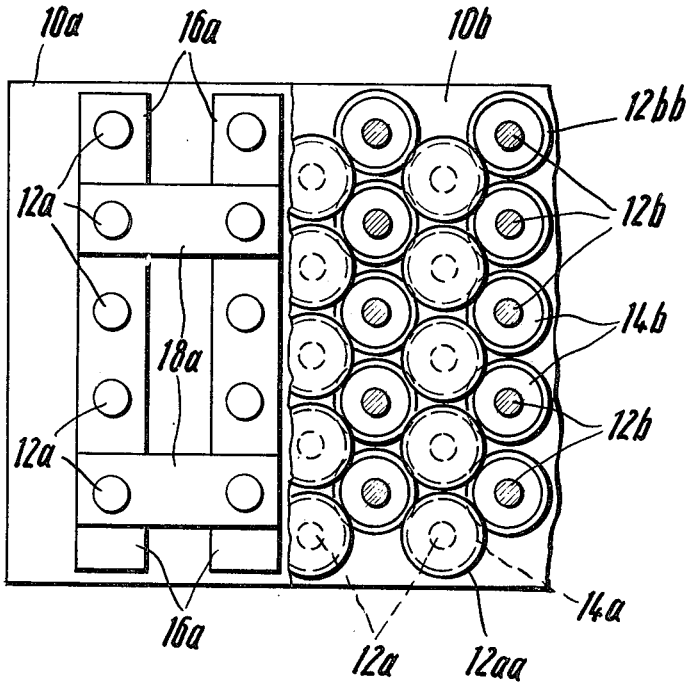
Fig. 2

SEPARABLE FASTENING

FIELD OF THE INVENTION

This invention relates to separable fastenings of the kind comprising two resilient carriers each supporting a plurality of rows of coupling pins with spherical substantially non-deformable heads, which can be brought by resilient deformation of the parent carrier into non-positive engagement behind oppositely located and offset heads of the other carrier to close the fastening.

BACKGROUND OF THE INVENTION

In such fastenings, which are sometimes referred to as snap fastenings and are used for example for the closing of belts or the like, there is a danger that the fastening may open in response to unintended but severe bending stresses in a particular direction, for example as a result of lateral pressure.

It is an object of the present invention to avoid this drawback and to provide a fastening which can only be opened in a predetermined and approved direction. To this end this invention consists in the improvement wherein each row of pins is mounted on a non-elastically deformable reinforcement connected to the parent carrier part in question with the reinforcements on each carrier disposed substantially at right angles to the longitudinal axis of the carrier, whereby the fastening can be separated in the direction of this axis only.

In accordance with a further feature of the invention the carrier part may be a plate, advantageously of rubber or the like with a fabric insert, and the pins on each plate are disposed with the heads of each row projecting from one side of the plate and rigidly connected to a reinforcement of strip form arranged at the other side of the plate and lying at right angles to the said direction of separation.

In a useful arrangement the coupling pins are made of metal and are connected by riveting or soldering to the reinforcing strips, which are also of metal.

In another arrangement each carrier is a plate of material of high elasticity and the coupling pins of each row and the corresponding reinforcement are made as a unit of strip form of material of lesser elasticity, this strip form unit being connected to the plate with the length of the strip form unit disposed at right angles to the said direction of separation.

A viable series production is catered for if the plate is of a thermoplastically moldable material, for example rubber, and the strip form unit is preformed from plastics material of less elasticity and is connected to the plate during thermoplastic molding of the latter.

In the case of belts or the like which are to be fastened together at their ends in the usual way, in accordance with a further feature of the invention at least two adjacent reinforcements disposed at one end of each carrier are firmly connected together by at least one bridge piece. This provides the fastening with an end closure which is very resistant to opening in an oblique or other unwanted direction.

A further object of the invention is to provide a very simple but nevertheless reliable arrangement for closing and opening the fastening. To this end use may be made of an operating member substantially S-form which is movable in a prescribed direction for opening and closing the two carriers of the fastening, said operating S-member having a central limb which, when the operating member is assembled on the fastening, extends between the carriers at right angles to the direction of separation, and is adapted to effect the separation of the pins of the respective carriers when pulled in one direction, and having two end limbs which also extend at right angles to the direction of separation and are adapted to bear on the outer sides of the carriers and to effect the closing of the fastening.

In a preferred form of this operating member the central limb is pivotally connected to a handgrip. This will help the unfastening and fastening operation in the case of wide fastenings. Moreover the handgrip can be made of various shapes suited to the appearance of the garment or belt.

A very simple method of limiting the closing and opening movement of this member is provided by a feature of the invention in which at least one of the carriers has an end abutment to cooperate with the corresponding end limb of the operating member and retain the latter in association with the fastening, the part of the end abutment facing the end limb of the operating member having a security notch to receive this limb.

A useful expedient is achieved where the inner side of each carrier is left free of coupling pins in the zone of the end abutment. This means that the ends of the two carrier parts can lie flat against one another in a closed position despite the presence of an S-member between them.

All the parts of the S-member can be made of circular cross section and of the same diameter. In this case the S-member can be made from metal wire or consist of a thermoplastic molding.

BRIEF DESCRIPTION OF THE DRAWINGS

Embodiments of the present invention are described below in reference to the accompanying drawings. In these drawings:

FIG. 1 is a side view of a first embodiment;

FIG. 2 is a plan view corresponding to FIG. 1, but with parts removed,

DETAILED DESCRIPTION

Figure 9:
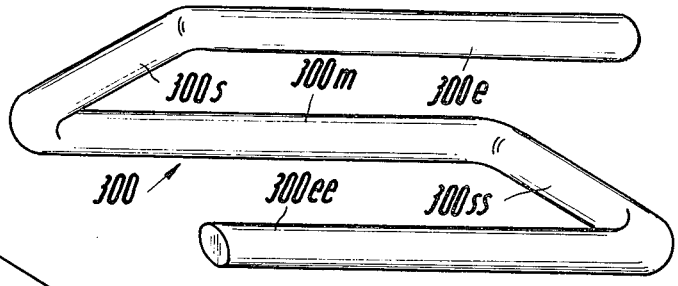
Figure 5:
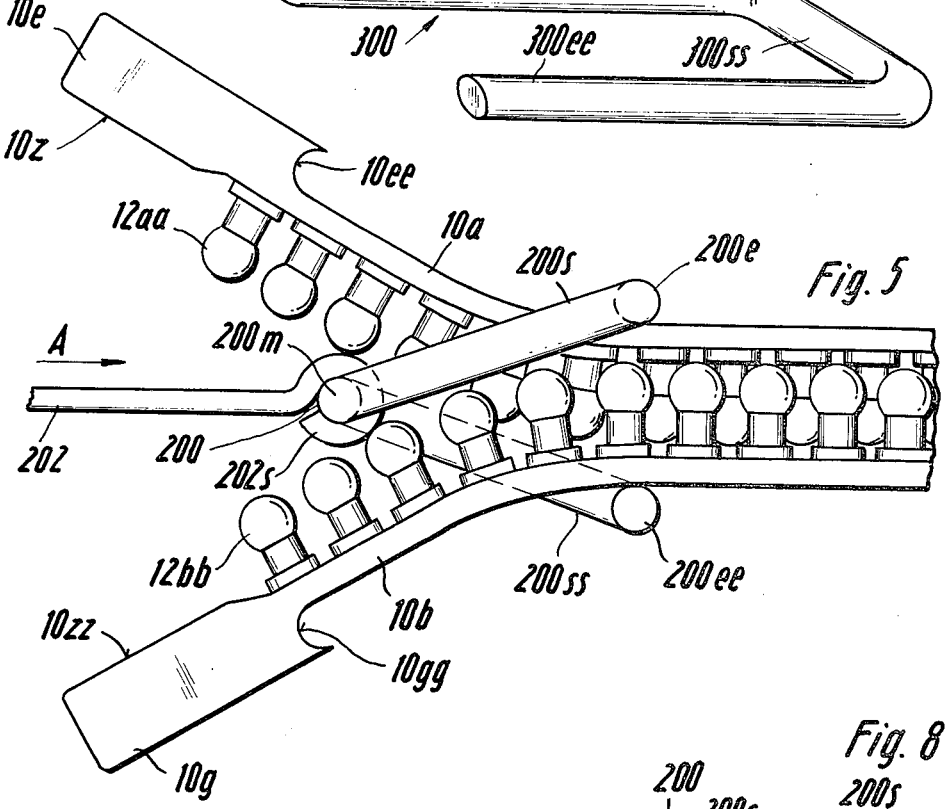
FIG. 5 illustrates on an enlarged scale the two carrier parts of the fastening with an S-member for opening and closing the fastening disposed between them.
Figure 6:
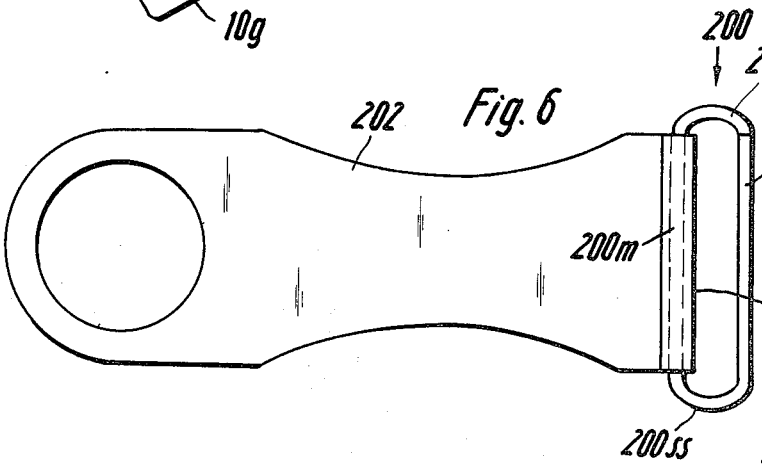
FIGS. 6 to 8 illustrate the S-member with a handgrip attached thereto, these being shown approximately in actual size.
Figure 8:
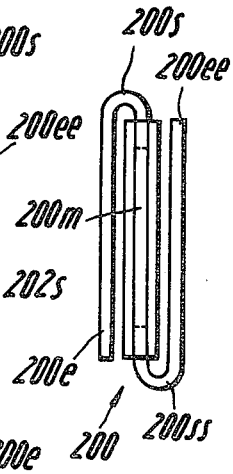
Figure 7:
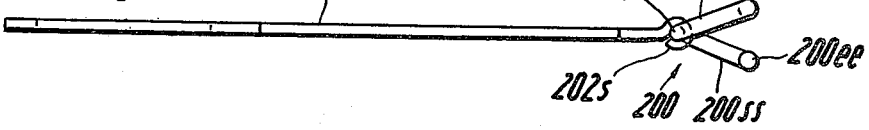

FIG. 9 shows another simpler form of the S-member.

The separable fastening in accordance with FIGS. 1 and 2 has two carrier parts 10*a* and 10*b* which are each made in the form of an elongated plate or strip of resiliently bendable, but non-extensible material. Rubber with a fabric inlay or plastic material of the required elasticity are for example suitable as a material for these carrier parts.

Coupling pins, 12*a* and 12 respectively, of like form and made of metal are incorporated in strips 10*b*, these pins being arranged in rows transverse to the longitudinal direction of the strip. Each coupling pin has a spherical head 12*aa* or 12*bb* and penetrates through an appropriately sized opening in the strip, a spacing sleeve 14*a* or 14*b* being arranged between the strip and each head. Elongated reinforcements 16*a* and 16*b* are arranged at the side of the carrier strips away from the heads transversely to the longitudinal direction of the latter. Pins 12*a* and 12*b* pass through appropriate openings in the reinforcements 16*a* and 16*b* and are connected at their ends to the latter, for example by riveting, so that each coupling pin 12, its spacing sleeve 14 and reinforcement 16 are firmly fixed on the associated carrier strip 10.

It is also to be noted that, as best shown by FIG. 2, the rows of coupling pins on one carrier strip are offset in the transverse direction through half the pin spacing in relation to the rows on the other carrier strip.

If the two carrier strips are slightly bent and moved towards one another in such a way that the coupling pins of one strip engage between those of the other strip, and the strips are then pressed together in the direction of the arrow indicated in FIG. 1, the heads 12*aa* of one strip 10*a* are moved behind the heads 12*bb* of the other strip 10*b* and the two carrier strips are held in the connected position by virtue of the non-positive interengagement, as illustrated at the lefthand side of FIG. 1. Non-positive coupling of strips 10*a* and 10*b* over their full length can be accomplished in this way.

Since the carrier strips 10*a* and 10*b* are of non-stretchable material, they cannot be extended to permit inadvertent release of the limpet-like attachment. The transverse reinforcements 16*a* and 16*b* also ensure that there will be no bending at the narrow edge of the strip which would permit an unintended release of the engagement in a direction transverse to the longitudinal direction of the strips. In practice, in fact, the two carrier strips can only be detached from one another by bending the two parts oppositely to the direction of the arrow in FIG. 1.

It is also to be observed that where the separable fastening is used in belts or the like it is of advantage to connect the last two adjacent reinforcements 16*a* and 16*b* at the ends of the carrier strips 10*a* and 10*b* by bridge pieces 18*a* and 18*b*. As a consequence of this the coupling heads can only be interengaged at this part under strong pressure, which thus provides a form of press fastening at this point.

A material of a rigidity suitable to the occasion can be used for the spacer sleeves 14 and reinforcements 16, that is to say metal, plastics or the like.

Figure 3:
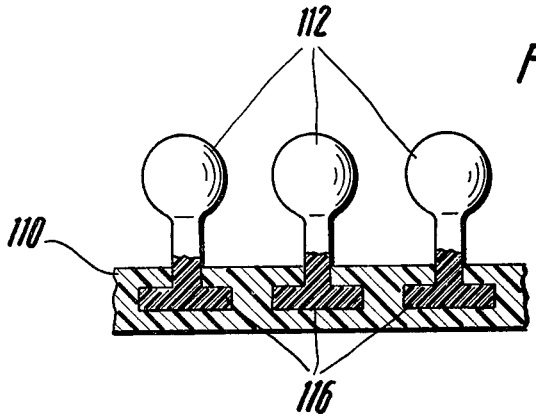
FIGS. 3 and 4 are respectively a part longitudinal section and a part plan view.
Figure 4:
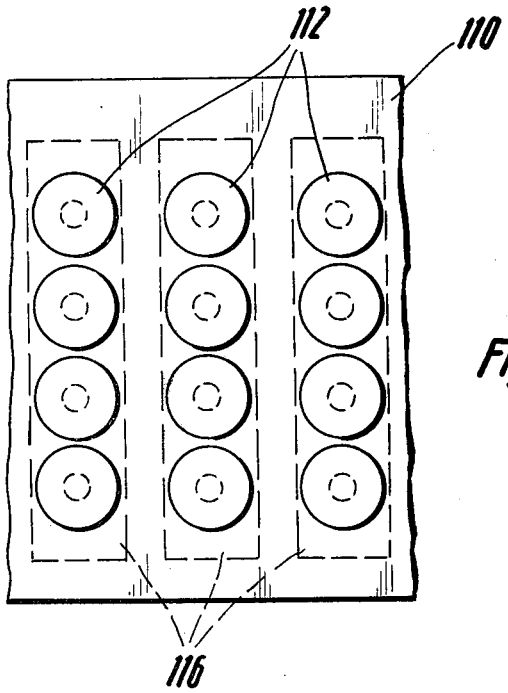

FIGS. 3 and 4 illustrate another embodiment of the separable fastening. In this case the coupling pins 112 and the transverse reinforcements 116 are integral and preformed of a suitable rigid material, for example plastics. The carrier strip 110 in this case is of an elastically bendable plastics material which is for example injection molded around the pre-formed units. In this construction the reinforcements cannot be seen from the exterior so that it is of a more pleasing appearance. In addition it is pointed out that units 112, 116 can be made of materials of the most varied coloring whereby belt fastenings or the like can be made very colorful.

FIGS. 5 to 8 illustrate an embodiment of the closure which includes an operating member of S-form is used for opening and closing the fastening. The two carrier strips 10*a* and 10*b* have coupling pins 12*aa* and 12*bb* similar to the fastening of FIGS. 1 and 2. In FIGS. 5 to 8 the operating S-member is denoted 200 and has a central limb 200*m* which, with the fastening assembled, lies at right angles to the direction A along which the fastening is opened. This central limb has at its ends two short limbs 200*s* and 200*ss* which extend therefrom at an angle. These side limbs are continued round into end limbs 200*e* and 200*ee* which are also at right angles to the direction A of separation and which bear against and slide along the outer faces of the carrier strips 10*a* and 10*b*. The central limb 200*m* is pivotally engaged by the circular knuckle 202*s* of a flat handgrip 202.

When the handgrip 202 is pulled in the separation direction A, the interengaged coupling pins 12*aa* and 12*bb* are pressed apart by the elements 200*m* and 202*s* to open and release the fastening. When these elements 202 and 200 are moved oppositely to direction A the two elements 200*e* and 200*ee* of the S-member 200 press the coupling pins 12*aa* and 12*bb* into reengagement to close the fastening.

The limit position of the operating S-member 200 is determined by two abutments 10*e* and 10*g* at the outer ends of carrier strips 10*a* and 10*b* which cooperate with the end limbs 200*e* and 200*ee* of the S-member. Each end abutment has a cavitied safety notch 10*ee* and 10*gg* to prevent escape of the end limb concerned. In addition wedge formations 10*z* and 10*zz* are arranged at the inner sides of the carrier strips 10*a* and 10*b* to hold the central limb 200*m* or 202*s* of the S-member 200 in the required central position between the strips 10*a* and 10*b* in the region of the end zone. As illustrated the end abutments and the wedge formations are an integral part of the carrier strips but special elements for this purpose could be applied to the carrier strips, for example be cemented thereto. The width of the S-member and that of the knuckle thereof are made appropriate to the width of the fastening. The laterally open end limbs enable the carrier strips to be made wider than the fastening itself.

Preferably a ductile, non-corroding metal rod or strip is used as material for the S-member. Advantageously, moreover, the handgrip can be made of a metal which can be worked to form the knuckle which engages the S-member. It is quite convenient to make the elements 200 and 202 of a moldable thermoplastic material. In the case of narrow fastenings and narrow carrier plates or strips a separate handgrip can be dispensed with the S-member itself directly gripped by two fingers of the user for the purpose of moving it. An S-member 300 of this nature is illustrated in FIG. 9. The parts 300*m*, 300*s*, 300*ss*, 300*e* and 300*ee* are of the same cross-sectional diameter.

As a corollary of this it should be mentioned that the outer diameter of the central limb (202*s* or 300*m* ) should be chosen of such a size that it does not penetrate too deeply into the gap between two adjacent rows of coupling pins such as would obstruct the motion of the S-member. When made of a plastics material (an injection molded element) the central limb of the S-member might have a rounded wedge form as viewed in cross section.

The embodiments of the invention in which an exclusive property or privilege is claimed are defined as follows:

1. In a separable fastening comprising two elastically deformable carriers each supporting a plurality of rows of coupling pins having spherical, substantially non-deformable heads, which heads can be brought by elastic deformation of one of the carriers into non-positive engagement behind oppositely located and offset heads of the other carrier to close the fastening, said carriers each having a strip form with a longitudinal dimension several times longer than the width dimension thereof, the improvement wherein each row of pins on each of said carriers extends substantially at right angles to the longitudinal axis of said carriers and has a separate and substantially non-elastic reinforcement member of a strip form connected to each of said pins in one of said rows and to one of said carriers to extend substantially at right angles to said longitudinal axis of said carrier, said reinforcement member having a longitudinal dimension substantially equal to the width dimension of said carrier, whereby the fastening can be separated only in the direction of said longitudinal axis of said carriers.

2. A fastening according to claim 1, wherein said coupling pins are disposed with the heads of each row projecting from one side of said carrier and rigidly connected to said reinforcing member arranged at the other side of said carrier.

3. A fastening according to claim 2, wherein said coupling pins are made of metal and are connected to said reinforcing members, which are also made of metal.

4. A fastening according to claim 1, wherein said carrier is made of a material of high elasticity and each reinforcing member with the coordinated coupling pins of one row made as a separate unit and of a material of strong elasticity.

5. A fastening according to claim 4, wherein said carrier is of a thermoplastically moldable material of high elasticity and said reinforcing strip with coordinated coupling pins of one row being preformed from plastics material of strong elasticity and connected to said carrier during a thermoplastic molding thereof.

6. A fastening according to claim 1, wherein at least two adjacent reinforcing members are disposed at one end of each of said carriers and are firmly connected together by at least one substantially non-elastic bridge piece.

7. A fastening according to claim 1, further including an operating member of substantially S-form which is movable in a prescribed direction for opening and closing said two carriers of the fastening, said operating S-member having a central limb which, when the operating member is assembled on the fastening, extends between said carriers at right angles to the direction of separation, and is adapted to effect the separation of the pins of the respective carriers when pulled in one direction, and having two end limbs which also extend at right angles to the direction of separation and are adapted to bear on the outer sides of the carriers and to effect the closing of the fastening.

8. A fastening according to claim 7, wherein said central limb of the operating member is pivotally connected to a handgrip.

9. A fastening according to claim 8, wherein at least one of said carriers has an end abutment to cooperate with the corresponding end limb of said operating member and retain the latter in association with the fastening, the part of said end abutment facing said end limb of said operating member having a security notch to receive this limb.

10. A fastening according to claim 9, wherein the inner side of each carrier is free of coupling pins on the zone of said end abutment.

* * * * *